United States Patent [19]

Maisch

[11] Patent Number: 4,549,515

[45] Date of Patent: Oct. 29, 1985

[54] FUEL INJECTION SYSTEM

[75] Inventor: Wolfgang Maisch, Schwieberdingen, Fed. Rep. of Germany

[73] Assignee: Robert Bosch GmbH, Stuttgart, Fed. Rep. of Germany

[21] Appl. No.: 687,899

[22] Filed: Dec. 31, 1984

[30] Foreign Application Priority Data

Mar. 16, 1984 [DE] Fed. Rep. of Germany ..... 3409763

[51] Int. Cl.[4] ..... F02M 69/00

[52] U.S. Cl. ..... 123/452; 123/455

[58] Field of Search ..... 123/452–455

[56] References Cited

U.S. PATENT DOCUMENTS

| | | | |
|---|---|---|---|
| 3,937,802 | 1/1976 | Echert | 123/455 |
| 3,993,034 | 11/1976 | Passera et al. | 123/452 |
| 4,341,192 | 7/1982 | Knapp et al. | 123/452 |
| 4,364,367 | 12/1982 | Echert | 123/453 |
| 4,501,247 | 2/1985 | Gassler et al. | 123/454 |
| 4,515,128 | 5/1985 | Jäggle et al. | 123/454 |

FOREIGN PATENT DOCUMENTS

| | | | |
|---|---|---|---|
| 2423109 | 12/1975 | Fed. Rep. of Germany | 123/453 |
| 3709559 | 3/1981 | Fed. Rep. of Germany . | |

*Primary Examiner*—Magdalen Y. C. Moy

*Attorney, Agent, or Firm*—Edwin E. Greigg

[57] ABSTRACT

A fuel injection system for internal combustion engines which has a metering valve disposed in a fuel supply line, in which adjusting characteristics for controlling the metering valve are strictly linear, thereby enabling a predictable, flexible fuel metering using simple and inexpensive control circuits. To this end, metering slits in the metering valve, which cooperate with a control piston in a known manner, are each connected to a respective differential pressure valve, which is adjusted such that the pressure differential ($p_{1,2}$) before and after the metering slits is constant, regardless of the size of the uncovered cross section of the metering slits. Thus the cross section of the metering slits uncovered at a given time is linearly dependent solely on the displacement travel (h) of the control piston, which in turn is proportional to a control pressure ($p_4$) exerted upon the control piston and generated by a pressure adjuster which operates in accordance with the operating characteristics of the engine.

13 Claims, 1 Drawing Figure

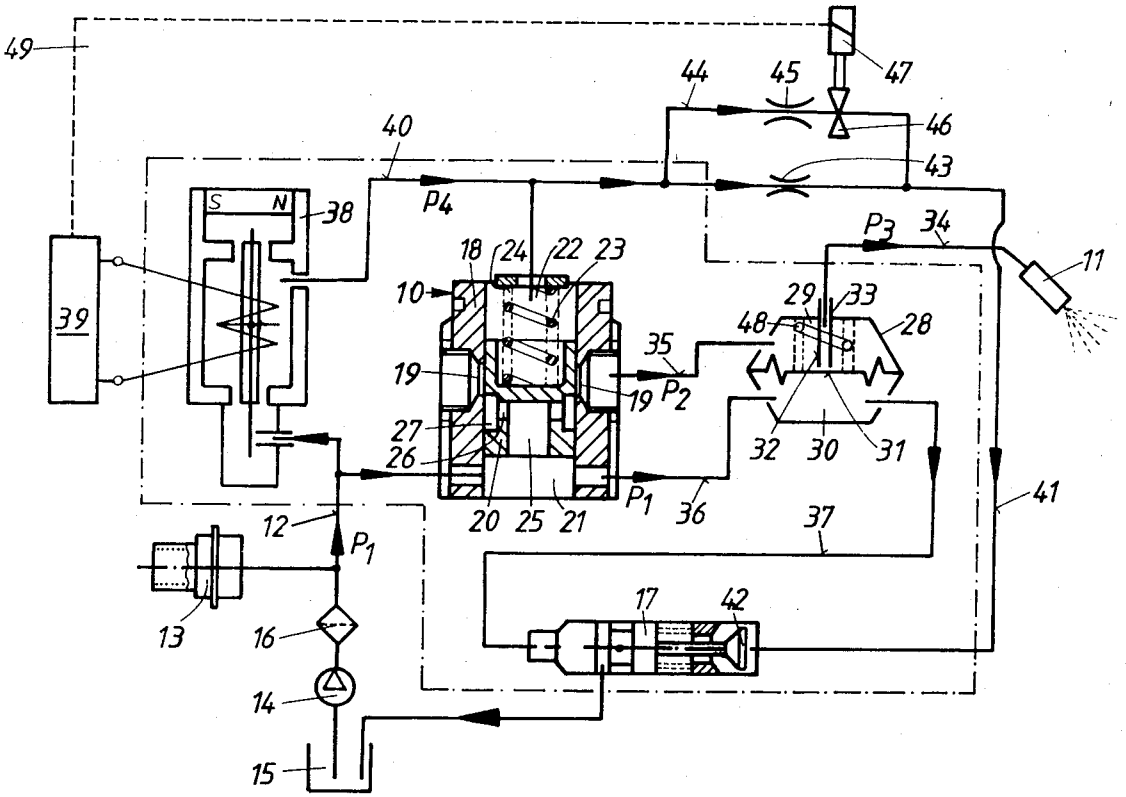
11
41
46
43
34
47
P3
28
33
31
45
29
30
37
48
32
44
42
35
P2
36
P1
17
23
19
22
21
24
25
18
20
P4
10
19
27
26
40
P1
38
N
S
12
16
14
15
13
39
49

FUEL INJECTION SYSTEM

BACKGROUND OF THE INVENTION

The invention relates to a fuel injection system for mixture-compressing internal combustion engines having externally supplied ignition.

In a known fuel injection system of this type (German Offenlegungsschrift 31 09 559), the differential pressure valve has two chambers divided by a valve diaphragm, which at the same time embodies the valve member; of these chambers, the one containing the valve outlet communicates with the metering slits, while the other has introduced into it the same control pressure that acts upon the control piston of the metering valve. As a result, the metered fuel quantity is determined by two variables, namely the position of the control piston and the opening cross section of the metering slits that is uncovered thereby on the one hand, and the pressure differential at the uncovered cross section of the metering slits on the other. The product of these two variables determines the total influence exerted and thus the fuel metering.

Although a control ratio of greater than 1:30 for the metered fuel quantity, despite a relatively low control ratio between the system pressure and the control pressure, can advantageously be attained with a known fuel injection system of this type, there is nevertheless the attendant disadvantage of nonlinear and unpredictable control characteristics.

OBJECT AND SUMMARY OF THE INVENTION

The fuel injection system according to the invention has the advantage over the prior art that the fuel metering is exclusively a function of the position of the control piston, resulting in strictly linear control characteristics and enabling the use of much simpler, more predictable and less expensive circuits for controlling a pressure adjuster that generates the control pressure in accordance with engine operating characteristics. At a constant pressure differential $p_{1,2}$ between the system pressure $p_1$ and the pressure $p_2$ downstream directly behind the metering slits, the quantity of fuel Q metered per unit of time is strictly linearly dependent upon the displacement travel h of the control piston of the metering valves in accordance with the following equation:

$$Q = k\sqrt{p_{1,2}} \cdot h.$$

The displacement travel of the control piston, in turn, is dependent on the control pressure $p_4$ in accordance with the following equation:

$$h = (p_1 - p_4)\frac{A_k}{c_f} - h_o.$$

in which k is a constant, $A_k$ is the control surface area of the control piston that is acted upon by the system pressure $p_1$ and the control pressure $p_4$, and $c_f$ is the spring constant of a compression spring engaging the metering valve control piston and acting counter to the system pressure $p_1$. The linear control characteristics also enable a predictable, flexible fuel metering, and in particular a control of starting, arbitrary closing functions when the engine is shut off, and an overrunning shutoff with a suitable reopening speed of the metering slits.

The system pressure $p_1$ does not need to be regulated very accurately; in other words, instead of a highly precise diaphragm pressure regulator, only a substantially less expensive piston pressure regulator is needed. Furthermore, the system pressure can be kept substantially lower, because the control pressure is not used to form the differential pressure $p_{1,2}$ between the system pressure $p_1$ and the pressure $p_2$ downstream immediately behind the metering slits.

As in the known fuel injection system, the advantage that it is possible to separate the metering valve spatially from the air flow rate meter is again retained. Also, an electrically operating air flow rate meter, such as a hot wire air flow rate meter, can again be used.

As a result of the provision of a throttle with a small throttling cross section and a further controlled throttle with a large throttling cross section, the reaction speed of the metering valve is increased substantially. On the one hand, because of the large throttling cross section that can be brought into play, the adjusting speed of the control piston in the direction of a larger cross section of the metering slits is increased considerably. On the other hand, a small control volume to be exerted by a pressure adjuster is sufficient for adjusting the control piston in the direction of a smaller cross section of the metering slits when the blocking valve is closed, that is, when the throttle with the large throttling cross section is inoperative, because the outflow volume via the throttle having the small cross section is minimal. A small control volume means a larger compression stroke of the pressure adjuster at a given electrical current. With the small control volume, a rapid control piston in the direction of a smaller cross section of the metering slits is also attained.

The play of the control piston in the metering valve does not have to be selected to be quite narrow, as in the known fuel injection valve with a view to good sealing of the gap, so that only very slight frictional forces arise between the control piston and the metering sleeve.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing is a schematic representation of a fuel injection system according to the invention.

DESCRIPTION OF THE PREFERRED EMBODIMENT

In the schematically represented fuel injection system shown in the drawing, 10 identifies a metering valve, which in accordance with operating characteristics of the internal combustion engine such as rpm, throttle valve position, temperature, exhaust gas composition, aspirated air quantity and the like, meters a fuel quantity which is capable of flowing via an injection valve 11 into the intake tube of the engine. At the metering valve 10, fuel can be metered separately to each cylinder of the mixture-compressing internal combustion engine having externally supplied ignition and can then be ejected into the intake tube through a separate injection valve 11 for each cylinder.

The metering valve 10 is connected to a fuel supply line 12 which is at system pressure $p_1$. Fuel is pumped into the fuel supply line 12, to which a fuel reservoir 13 is also connected, from a fuel container 15 via a filter 16 by means of a fuel pump 14. The approximately constant system pressure $p_1$ in the fuel supply line 12 is maintained by means of a piston pressure regulator 17, by way of which fuel flows back into the fuel container 15 if the system pressure $p_1$ is exceeded.

The metering valve 10 has a metering sleeve 18, in which metering slits 19 are disposed, and a control piston 20 that is axially displaceable in the metering sleeve 18. On the opposite ends of the control piston 20 in the metering sleeve 18, there is a fuel supply chamber 21 at one end communicating with the fuel supply line 12 and a control chamber 22 on the other end, by way of which the control piston 20 can be acted upon by a control pressure $p_4$. A restoring spring 23 is also disposed in the control chamber 22, being supported at one end on the control piston 20 and at the other end on the bottom 24 of the control chamber.

The control piston 20 has a blind bore 25 beginning at its end face oriented toward the fuel supply chamber 21, which blind bore 25 communicates via radial bores 26 with a circumferential annular groove 27 on the control piston outer surface. The circumferential annular groove 27 cooperates with the metering slits 19 and in accordance with the position of the control piston 20 uncovers an opening cross section of the metering slits 19 of more or less large area. If the fuel supply chamber 21 is pressureless, then the control piston 20, under the influence of the restoring spring 23, assumes the basic position shown in the drawing, in which the metering slits 19 are completely covered by the control piston 20 or are uncovered with a certain minimum cross section.

A differential pressure valve 28 is connected to each metering slit 19 and its outlet communicates with the injection valve 11. The differential pressure valve 28 has two chamber 29 and 30, divided from one another by a valve diaphragm 31. The valve diaphragm 31 cooperates with a valve seat, which is formed by the end face of an outlet tube 33 disposed in the first chamber 29 to which a line 34 to the injection valve 11 is connected. A pressure $p_3$ prevails in the outlet tube 33 and in the pressure line 34 joining the outlet tube 33 to the injection valve 11. The first chamber 29 communicates via a schematically drawn pressure line 35 with the metering slit 19. In this pressure line 35 and in the first chamber 29, the pressure $p_2$ prevails. The second chamber 30 communicates on the one hand with the fuel supply chamber 21 of the metering valve 10, via a pressure line 36 also drawn schematically, and on the other hand with the piston pressure regulator 17 via a pressure line 37. Thus the system pressure $p_1$ established by the piston pressure regulator 17 prevails in the second chamber 30, as in the supply line 12 and the pressure lines 36 and 37.

Also connected to the fuel supply line 12 is a pressure adjuster 38, which is controlled by an electronic control unit 39 in accordance with engine operating characteristics such as rpm, throttle valve position, temperature, exhaust gas composition, aspirated air quantity, and the like and generates a corresponding control pressure $p_4$. The pressure adjuster 38 may be embodied as an electrofluid converter of the nozzle/impact plate type, the structure and mode of operation of which is described in German Offenlegungsschrift 31 09 559. The outlet of the pressure adjuster 38 communicates via a control line 40 with the control chamber 22 of the metering valve 10. Branching off from the control line 40 or from the control chamber 22 of the metering valve 10 is a fuel return line 41, which is closed off at its end with a sealing valve 42, embodied as a push-open valve, which is integrated with the piston pressure regulator 17. A first throttle 43 having a relatively small throttling cross section is incorporated in the return line 41 between the connection to the control chamber 22 and the regulator 17. The first throttle 43 is bypassed by a bypass line 44. Disposed in series in the bypass line 44 are a second throttle 45, having a large throttling cross section, and an electromagnetically actuated blocking valve 46. The control magnet 47 of the blocking valve 46 is controlled by the electronic control unit 39. The cross section of the first throttle 43 is dimensioned such that slow adjusting movements of the control piston 20 in the direction of an enlargement of the cross section of the metering slits 19, at which control volume must flow out by way of the throttle 43, can take place within the adjusting time allowed for it. The greater the current flow, the less the pressure from control valve 38 to the chamber 22 will be.

The differential pressure valve 28 connected at the outlet side to the metering slits 19 on the one hand and on the other to the fuel supply chamber 21 of the metering valve 10 and hence to the fuel supply line 12 is adjusted in such a manner that the differential pressure $p_{1,2}=p_1-p_2$ is always constant, regardless of the opening cross section of the metering slits 19 uncovered by the control piston 20. To this end, a compression spring 48 is disposed in the first chamber 29 of the differential pressure valve 28, supported at one end on the chamber bottom and on the other end on the valve diaphragm 31. The compression spring 48 generates a force acting upon the valve diaphragm 31, which acts in the opposite direction from the pressure force generated by the system pressure $p_1$ and exerted from the direction of the second chamber 30.

The mode of operation of the fuel injection system described is as follows:

In the fuel supply line 12, the system pressure $p_1$ is established by means of the piston pressure regulator 17. Acting upon the control piston 20 of the metering valve 10 are the system pressure $p_1$, from the direction of the fuel supply chamber 21, and the control pressure $p_4$, from the direction of the control chamber 22. The control pressure $p_4$ is generated by the pressure adjuster 38 as a differential pressure $p_{1,4}$. The differential pressure $p_{1,4}$ is arrived at in accordance with the following equation:

$$p_{1,4}=p_O+c_1 \cdot I \tag{1}$$

wherein I is the electrical current, established by the electronic control unit 39, in the magnet coil of the pressure adjuster 38, $c_1$ is a constant and $p_o$ is a constant adjustable pressure drop when $I=0$.

At the control piston 20, a balance of forces is established in accordance with this equation:

$$p_1 \cdot A_k - p_4 \cdot A_k - K_F = 0 \tag{2}$$

wherein $A_k$ is the piston pressure surface area acted upon by the system pressure $p_1$ and the control pressure $p_4$. The spring force $K_F$ is determined by $$K_F = K_O + c_f h \tag{3}$$

wherein $c_f$ is the spring constant of the restoring spring 23 and h is the displacement travel of the control piston 20.

From equations (1)–(3), the displacement travel h of the control piston 20 can be determined as $$h = \frac{c_1}{c_f} A_k \cdot I + \frac{p_o A_k - K_o}{c_f}. \quad (4)$$

The displacement travel h of the control piston 20 determines the opening cross section of the metering slits 19 and thus directly determines the quantity of fuel Q flowing through the metering slits per unit of time. This quantity is determined from the following equation:

$$Q = k\sqrt{p_{1,2}} \cdot h. \quad (5)$$

Since the differential pressure $p_{1,2}$ is constant, the fuel quantity Q metering in the unit of time is proportional solely to the piston travel h and, in accordance with equation (4), to the current I in the magnet coil of the pressure adjuster 38.

The constant travel component $$(p_o A_k - K_o)/c_f$$

affords the possibility of adjusting the displacement travel h, at I=0, to a suitable value, for instance to an opening of the metering slits 19 for a partial-load operating point, so that in the currentless state of the pressure adjuster 38 emergency operation is possible.

If the electronic control unit 39 calls for a rapid upward movement of the control piston 20 in the direction of a larger cross section of the metering slits 19 on the basis of engine operating variables, then not only is the control pressure $p_4$, reduced considerably by means of a corresponding current I, but the control magnet 47 of the blocking valve 46 is also triggered by the electronic control unit 39. The blocking valve 46 then opens, and the opening cross section of the throttle 45, in addition to the first throttle 43, is available for outflow into the return line 41 on the part of the control volume positively displaced upon the upward movement of the control piston 20. The control magnet 47 is triggered for a longer period, and the blocking valve 46 thus opened for a longer period, the more rapidly the control piston 20 is supposed to travel upward, and the longer is the distance of displacement travel h that is to be accomplished. In other operating states, for instance in the event only of slow upward displacement movements of the control piston 20, for only very short adjustment distances, or when the control piston 20 is displaced downward in the direction of a decrease in the free opening cross section of the metering slits 19, the blocking valve 46 is closed, so that only the small cross section of the throttle 43 is operative.

The metering valve 10, the differential pressure valves 28, the pressure adjuster 38 and the piston pressure regulator 17 with the sealing valve 42 are suitably combined into a structural unit, which is symbolically indicated in the drawing by a dot-dash line encompassing it.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection system for mixture-compressing internal combustion engines with externally supplied ignition, comprises at least one metering valve, disposed in a fuel supply line which is at system pressure, for metering fuel in accordance with engine operating characteristics, said at least one metering valve having a control piston displaceable in a metering sleeve that has a metering slit for each cylinder of said engine, the control piston being acted upon by a control pressure established in accordance with the engine operating characteristics thereby and uncovering a corresponding cross section of the metering slits toward a fuel supply line to a greater or lesser extent, and having a differential pressure valve connected to each metering slit, the differential pressure valve communicating on the outlet side with an injection valve, wherein the metering sleeve has on one end face of the control piston a fuel supply chamber, connected to the fuel supply line, and on its opposite end a control chamber communicating with a pressure adjuster generating a control pressure, the control chamber communicating via a first throttle with a fuel return line, said first throttle having a very small flow cross section, and a second throttle connected in parallel with said first throttle, said second throttle having a substantially larger flow cross section in series with a blocking valve operated by a control device.

2. A system as defined by claim 1, in which the flow cross section of said first throttle is dimensioned to be large enough that slow adjusting movements of said control piston in a direction of an enlargement of a cross section of said metering slits take place within an adjustment time allowed therefor.

3. A system as defined by claim 1, in which said control device of said blocking valve and a pressure adjuster are controlled by an electronic control unit and the operating characteristics of the engine are supplied in the form of electrical input variables to said electronic control unit.

4. A system as defined by claim 2, in which said control device of said blocking valve and a pressure adjuster are controlled by an electronic control unit and the operating characteristics of the engine are supplied in the form of electrical input variables to said electronic control unit.

5. A system as defined by claim 1, which includes a differential pressure valve between said at least one metering valve and a piston pressure regulator that includes a sealing valve.

6. A system as defined by claim 2, which includes a differential pressure valve between said at least one metering valve and a piston pressure regulator that includes a sealing valve.

7. A system as defined by claim 3, which includes a differential pressure valve between said at least one metering valve and a piston pressure regulator that includes a sealing valve.

8. A system as defined by claim 2, in which said fuel supply chamber communicates with an outer annular groove in said control piston which outer annular groove cooperates with said metering slits in said metering sleeve.

9. A system as defined by claim 3, in which said fuel supply chamber communicates with an outer annular groove in said control piston which outer annular groove cooperates with said metering slits in said metering sleeve.

10. A system as defined by claim 4, in which said fuel supply chamber communicates with an outer annular groove in said control piston which outer annular groove cooperates with said metering slits in said metering sleeve.

11. A system as defined by claim 5, in which said fuel supply chamber communicates with an outer annular grove in said control piston which outer annular groove cooperates with said metering slits in said metering sleeve.

12. A system as defined by claim 6, in which said fuel supply chamber communicates with an outer annular groove in said control piston which outer annular groove cooperates with said metering slits in said metering sleeve.

13. A system as defined by claim 7, in which said fuel supply chamber commuicates with an outer annular groove in said control piston which outer annular groove cooperates with said metering slits in said metering sleeve.

* * * * *